United States Patent [19]

Kolanski

[11] Patent Number: 5,065,166

[45] Date of Patent: Aug. 20, 1991

[54] ANTI CANCELLATION ANTENNA

[75] Inventor: Adam Kolanski, Holland Landing, Canada

[73] Assignees: Sinclair Radio Laboratories Limited, Aurora, Canada; Sinclair Radio Laboratories Limited, Aurora, Canada

[21] Appl. No.: 377,558

[22] Filed: Jul. 10, 1989

[30] Foreign Application Priority Data

Apr. 14, 1989 [CA] Canada ..... 595108

[51] Int. Cl.[5] ..... H01Q 9/30

[52] U.S. Cl. ..... 343/826; 343/846

[58] Field of Search ..... 343/826-831, 343/833, 893, 846, 850

[56] References Cited

U.S. PATENT DOCUMENTS

| | | | |
|---|---|---|---|
| 2,245,693 | 6/1941 | Lindenblad | 343/826 |
| 2,966,678 | 12/1960 | Harris | 343/826 |
| 3,071,771 | 1/1963 | Scheldorf | 343/830 |
| 3,524,191 | 8/1970 | Ehrenspeck | 343/833 |

FOREIGN PATENT DOCUMENTS

| | | | |
|---|---|---|---|
| 188507 | 8/1987 | Japan | 343/826 |

*Primary Examiner*—Michael C. Wimer

[57] ABSTRACT

An antenna has an odd number of upwardly diverging monopoles equiangularly spaced about a vertical axis.

4 Claims, 3 Drawing Sheets

ANTI CANCELLATION ANTENNA

This invention relates to an antenna to be used for receiving and transmitting in an expected range of about 800 MHz to 1.4 GHz. The range however is not limiting.

Monopole antennas for use in or near the said frequency range, particularly on mobile radio sets, are subject to loss of reception or transmission weakness or loss because the signal travels in two (or more) paths between the antenna and the station with which it is communicating and the phase relationship(s) between the multiple signals cause cancellation or near cancellation of the cumulative signal. With dipoles the same cancellation may result.

This invention therefore provides that an odd number of monopole members are provided with their main extents extending upwardly from a base and equiangularly spaced about a vertical axis. The main extents diverge in the upward direction at an angle of at least 30° (and preferably about 40°) to the vertical axis. The length of the diverging extent of each monopole will be 15%–25% of the wavelength at the centre of the desired band width. The base of the diverging extent is extended to a common connection point for the signal lead, usually the central conductor of a coaxial cable. The outer conductor of the coaxial cable will be connected to the ground plane which is perpendicular to the vertical axis which is the (approximate) axis of symmetry of the diverging monopoles. The ground plane is insulated from the monopoles and their connections.

The axis of symmetry is referred to above as 'approximate'. The invention extends to a device where the monopoles, equiangularly spaced about the vertical axis of symmetry, are identical as to connections and geometry. However it is preferred to introduce differences in the horizontal connections to the diverging extents preferably also in outer bent portions which introduce a phase difference of 3–4% of the antenna central wavelength between the signal path of any two monopoles.

The phase difference of 3–4% between the signal paths to any two monopoles may result in a phase difference of up to 15% of the antenna central wavelength between the monopoles with the widest phase difference.

In a preferred embodiment of the invention each monopole has a horizontal extent integrally connected to the base of the diverging extent. The integral connection provides good electrical connections and may be dimensioned to reduce problems of impedance matching. The shortest and longest horizontal extents preferably differ in length (from the median extent) to provide a phase difference of 3 to 4% of the central wavelength of the bandwidth.

In a preferred embodiment, the outer end of each diverging extent is bent at 90° to 180° to provide an outer short bent extension. The extension lengthens the effective length of the diverging extent to effectively $\frac{1}{4}$ of the central wavelength with a diverging extent somewhat (as much as 10%) less than the $\frac{1}{4}$ wavelength value. Thus the diverging extent may be made shorter since the bent outer extension is used allowing a new compact device which is of considerable importance in mobile installations.

The expected frequency range within which the device will be used in 800 MHz to 1.4 GHz. However the lower limit is only a practical one and exists because at lower frequencies the device may be awkwardly large. Thus the device is operable at 400 MHz, but would be considered too large for many mobile installations.

Preferably there are 3 monopoles in equiangular arrangement at 120° intervals about the (approximate) axis of symmetry. Each monopole is preferably designed to provide phase difference to signals between the monopole and the central lead which provides signals which are about 3–4% out of phase with the signals from another monopole which are the next nearest in phase.

In drawings which illustrate a preferred embodiment of the invention:

Figure 3:
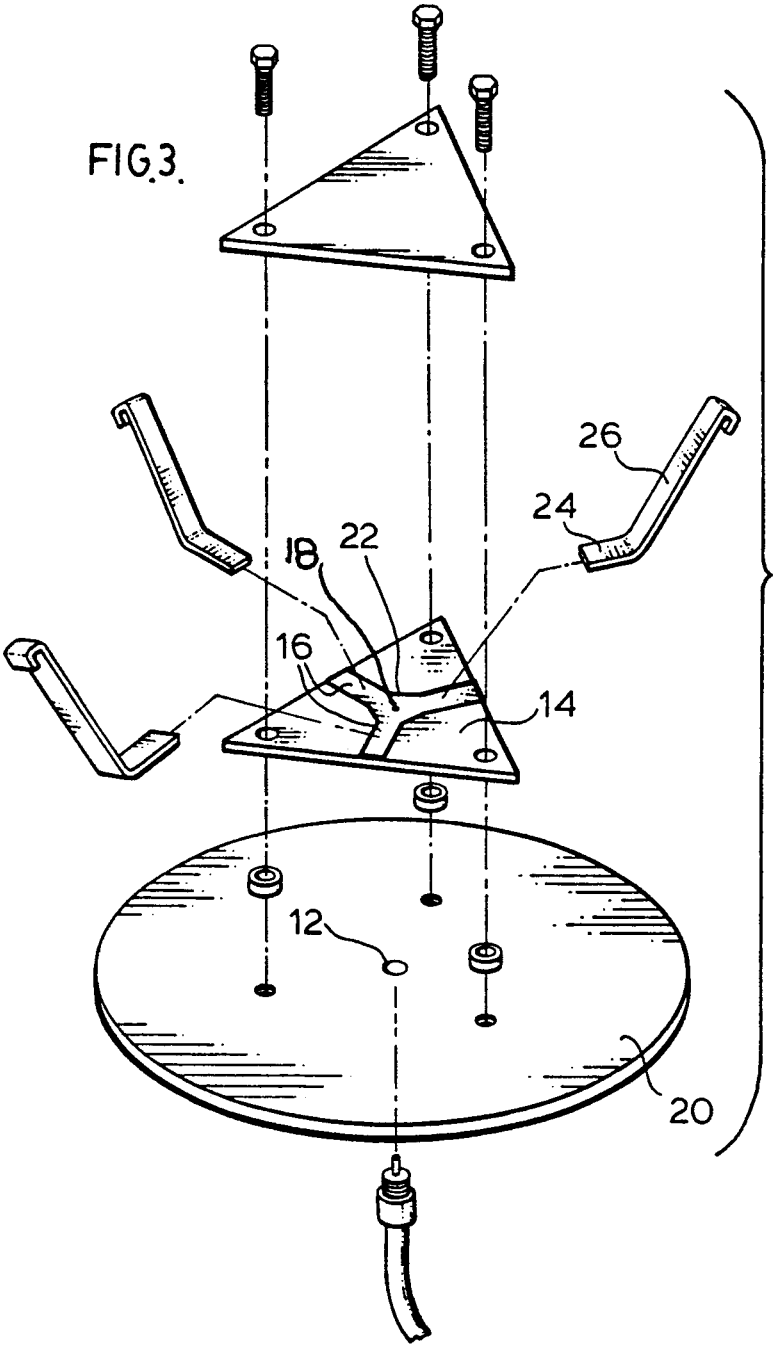
FIG. 3 is an exploded view of the device in FIG. 1.
Figure 4:
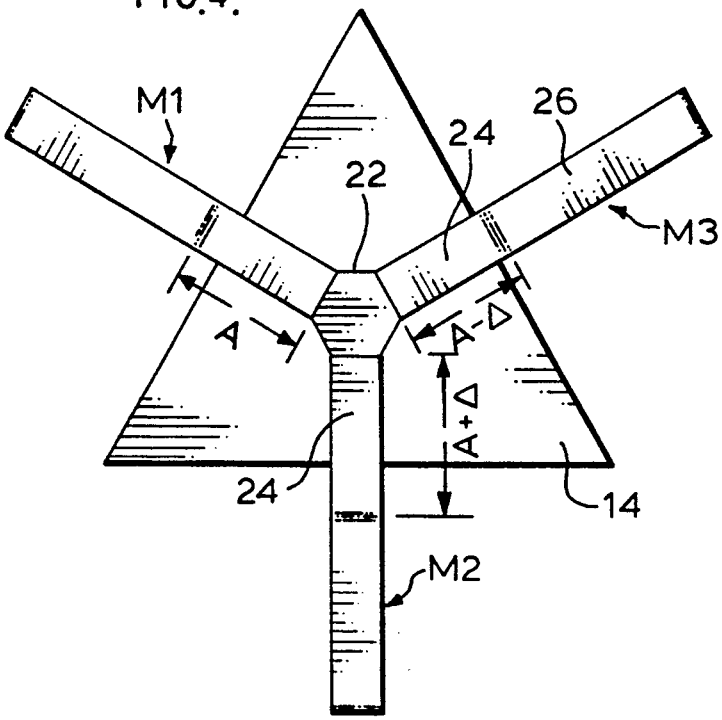
FIG. 4 is a top view of the device of FIG. 1.
Figure 5:
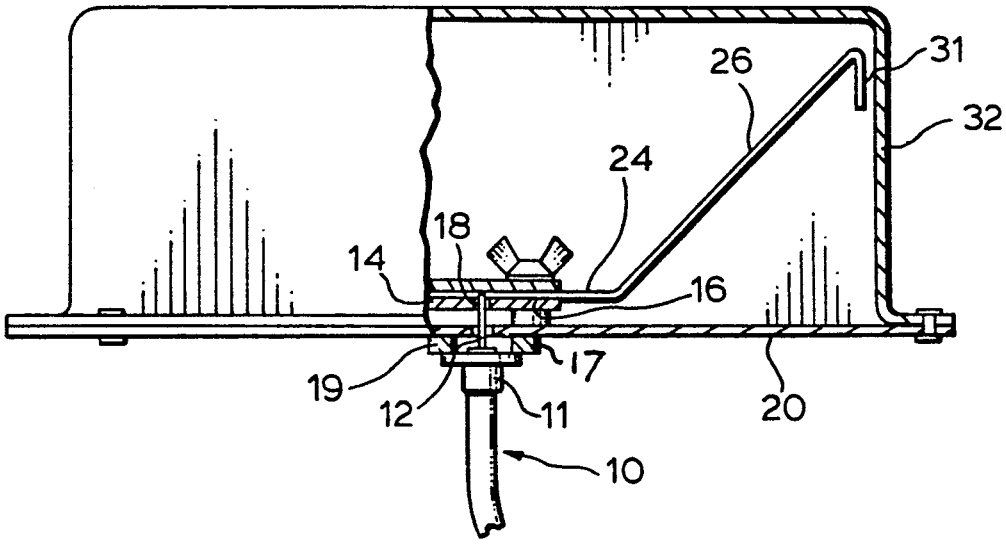
FIG. 5 is a vertical section of the device of FIG. 1 with the exception that a different outer extension is shown and also a protective casing.

In the drawings all views may be considered as representative of the preferred embodiment with the exception that FIGS. 1–4 show one shape of outer extension for the monopoles and FIG. 5 shows another, and FIG. 5 shows a protective casing for the device and different clamping bolts.

In the drawings FIGS. 1–4 a coaxial lead 10 from a transmitter or receiver (not shown) has the outer conductor bushing 11 directly electrically connected about the aperture 12 to a conducting flat circular ground plane 20. The ground plane 20 will be, in use, horizontal.

As shown in FIGS. 5 the outer conductor bushing 11 may be electrically connected to conducting flange 17 which is electrically connected to ground plane 20 through the conducting spacers 19. The conducting spacers are optional and the principal reason for their use is to provide the proper spacing between the cable and ground plane 20 when the cable is inside a vehicle and the ground plane 20 is mounted on the roof thereof.

The terms 'horizontal' and 'vertical' herein are used having regard to the main use of the invention namely with mobile equipment. With mobile equipment, the terrain or base for the set will frequently be uneven thus 'horizontal' and 'vertical' refer to average orientation of the equipment rather than to its exact orientation at any one time.

A triangular insulating plate 14 is mounted on the upper side of the base plane. The upper surface of the insulating plate is provided with a copper laminated layer providing radially extending strips 16 to the right bisectors of the triangle. The insulating plate 14 is provided with a central aperture 18 aligned with the aperture in plane 20.

The base plane 20, plate 14 and all active components of the device hereafter to be described display 3-way symmetry about a vertical axis A through the aligned apertures with the exception to the symmetry of small differences in the monopole members to provide a phase difference as described hereafter.

Fillets 22 of the same conductor material as strips 16 are provided between the roots of the laminated strips as shown.

Each monopole member is preferably of copper strip and comprises a horizontal extent 24 designed to be soldered in conducting relationship to a corresponding laminated strip 16 and the layer and monopole strip are preferably of equal width.

The horizontal strip extent 24 extends integrally into a diverging extent 26 having an angle of between 30° and 60° (preferably 40°) to the vertical axis. The length of the diverging extent 26 will be 15–20% of the central wavelength of the antenna.

At its outer extremity the diverging extent 26 is provided with an outwardly bent extension 30 bent to form an angle of greater than 90° such as 180° (FIGS. 1–4) or an extension 31 bent to form an angle of 135° (FIG. 5) and the bend may be of greater than 180°, all angles being of the end portion of the extension relative to extent 26.

As demonstrated in FIG. 4 the horizontal extents of the strips may vary by amounts $\pm\Delta$ where $\Delta$ is about 1 ½-2% of the central wavelength, producing a corresponding difference in radial dimension location of the diverging extents 26. The dimension "A" in FIG. 2 may differ as between its median value and either of the shorter or longer by between 1 ½ to 2% of the central wavelength as may the similar relationships of dimension C.

Thus the dimensions A,B,C and D for an antenna with a bandwidth of 1350 to 1400 MHz is set out below (dimensions in inches).

| | A | D | C | B |
|---|---|---|---|---|
| M1 | 13/16 | 3/16 | 5/16 | 1 11/16 |
| M2 | ⅞ | 7/32 | 11/32 | 1 11/16 |
| M3 | ¾ | 5/32 | 9/32 | 1 11/16 |

The sloping dimension B is the same for all monopoles. The accumulated effect of the A,D,C dimensions is to provide about a 5% phase difference in the signals between the connector and monopole M1 (the median) and in one sense, monopole M2, and in the other sense, monopole M3.

Each antenna will have a designed bandwidth on each side of the frequency of the central wavelength, herein.

The bandwidth will be a design consideration for determination in accord with principles well known to those skilled in the art. Factors effecting the bandwidth include the thickness, shape and material of the insulating member 14 and the pattern and dimension of the filleted three pointed star laminate 16 and the spacing from ground plane 20.

As will be noted FIGS. 1–4 show outer integral extensions for diverging extents 26 which are bent at 180°, relative to the diverging extent, or in hairpin arrangement; while FIG. 5 shows an outer extension 31 bent at 135° to the extent 26. In general such extension may be bent at 90° to 360° and in the latter case may contact the outer extremity of the extension 26.

FIG. 5 shows a protective casing 32 attached to the ground plane 20 to provide protection of the monopoles and associated equipment from weather, and dust etc.

FIG. 3 shows a bolt construction for connecting the element and particularly for clamping horizontal extents 24 horizontally on to laminate 16 (to which they are also soldered); FIG. 5 shows a different bolt construction.

Figure 1:
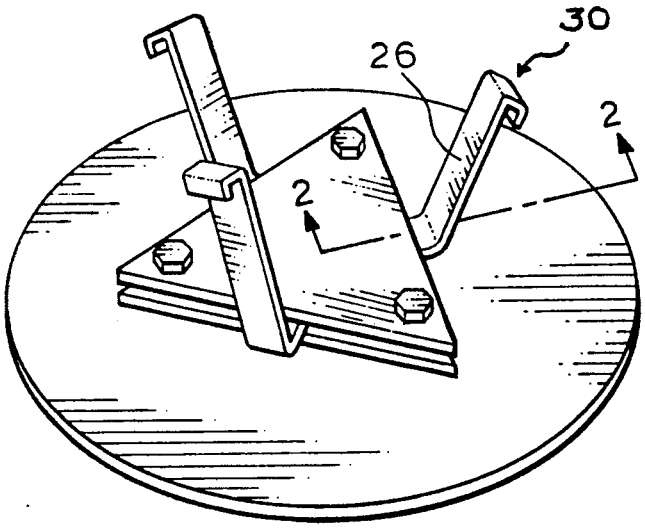
FIG. 1 is a perspective view of the antenna.
Figure 2:
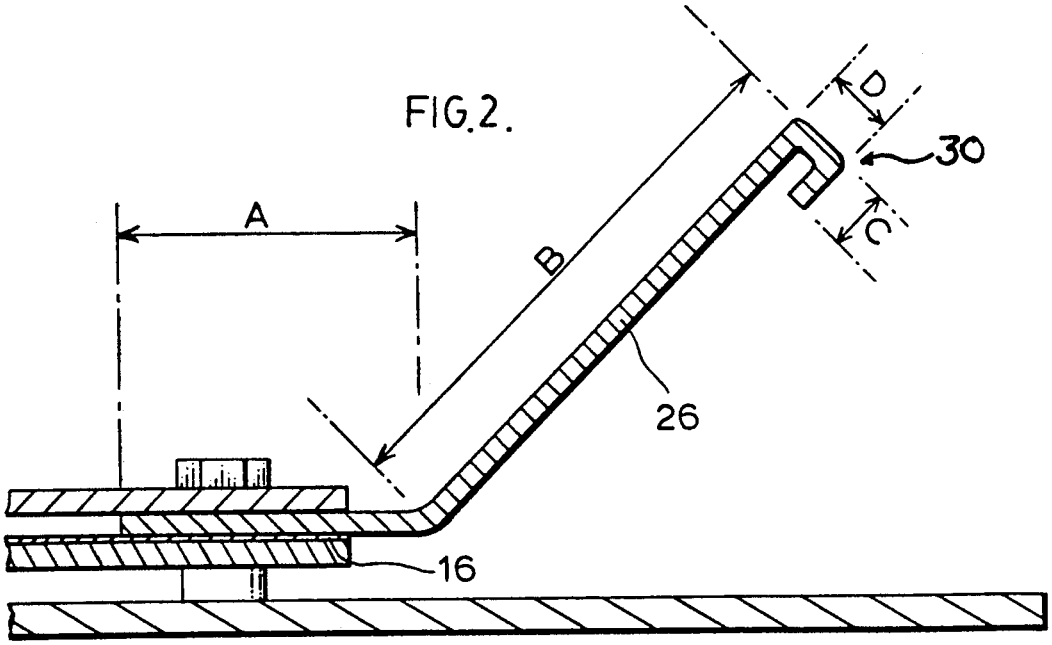
FIG. 2 is a sectional view along the lines 2—2 of FIG. 1.

The laminate 16, shown in FIG. 2 is present in the alternative of FIG. 5 although not clearly shown because of the scale.

I claim:

1. Antenna having a central wavelength comprising:

an odd number of conducting monopole members extending upwardly from a base support and equiangularly disposed about a vertical axis, each monopole member comprising mainly an upwardly diverging extent sloping at, at least, 30° to said vertical axis, and being supported at its lower end on said base support insulated from a ground plane, a signal lead connected to said odd number of monopole members, and a ground lead connected to said ground plane, the lower end of each said monopole member having an integral horizontal extension rom the lower end of said diverging extent to the signal lead, said monopole members including said horizontal extensions being a length to provide signals relative to the same signal on the signal lead whose widest phase difference is less than 15% of said predetermined wavelength, wherein there are three monopole members wherein the diverging extents are of substantially equal length but said monopole members including said horizontal extensions are of a length to cause a phase different between signals on the three diverging extents relative to the signal lead, the widest phase difference being less than 15% of the central wavelength, and where said horizontal extensions of said three diverging extents are made of lengths differing by a small proportion of said diverging extent to, at least partially cause said phase difference.

2. Antenna having a central wavelength comprising:

an odd number of conducting monopole members extending upwardly from a base support and equiangularly disposed about a vertical axis, each monopole member comprising mainly an upwardly diverging extent sloping at, at least, 30° to said vertical axis, and being supported at its lower end on said base support insulated from a ground plane, a signal lead connected to said odd number of monopole members, and a ground lead connected to said ground plane, the lower end of each said monopole member having an integral horizontal extension from the lower end of said diverging extent to the signal lead, said monopole members including said horizontal extensions being of a length to provide signals relative to the same signal on the signal lead whose widest phase difference is less than 15% of said predetermined wavelength, wherein the diverging extents are of substantially equal length but said monopole members including said horizontal extensions are of a length to cause a phase difference between signals on the diverging extents relative to the same signal on the signal lead, the widest difference being 15% of the central wavelength, and where said horizontal extensions of said diverging extents are made of lengths differing by a fraction of said diverging extent to, at least partially, cause said phase difference.

3. Antenna having a central wavelength comprising:

an odd number of conducting monopole members extending upwardly from a base support and equiangularly disposed about a vertical axis, each monopole member comprising mainly an upwardly diverging extent sloping at, at least, 30° to said vertical axis, and being supported at its lower end on said base support insulated from a ground plane, a signal lead connected to said odd number of monopole members, and a ground lead connected to said ground plane, the lower end of each said monopole member having an integral horizontal extension from the lower end of said diverging extent to the signal lead, said monopole members including said horizontal extensions being of a length to provide signals relative to the same signal on the signal lead whose widest phase difference is less than 15% of said predetermined wavelength, wherein an outer extension is provided integrally connected to the outer end of said diverging extent, said outer extension being generally in the same plane containing said vertical axis as said diverging extent and at an angle of 90°–180° thereto, wherein the diverging extents are of nearly equal length but said monopole members are of a length to cause a phase difference between signals on the three diverging extents relative to the same signal on the signal lead, the widest phase difference being less than 15% of the central wavelength, and wherein said outer integral extensions of said three diverging extents are made of lengths differing by a small proportion of said diverging extent to provide said phase difference.

4. Antenna having a central wavelength comprising:

an odd number of conducting monopole members extending upwardly from a base support and equiangularly disposed about a vertical axis, each monopole member comprising mainly an upwardly diverging extent sloping at, at least, 30° to said vertical axis, and being supported at its lower end on said base support insulated from a ground plane, a signal lead connected to said odd number of monopole members, and a ground lead connected to said ground plane, the lower end of each said monopole member having an integral horizontal extension from the lower end of said diverging extent to the signal lead, said monopole members including said horizontal extensions being of a length to provide signals relative to the same signal on the signal lead whose widest phase difference is less than 15% of said predetermined wavelength, wherein an outer extension is provided integrally connected to the outer end of said diverging extent, said outer extension being generally in the same plane containing said vertical axis as said diverging extent, and at an angle of 90°–180° thereto, wherein the diverging extents are of nearly equal length but said monopole members are of a length to cause a phase difference between signals on the three diverging extents relative to the same signal on the signal lead, the widest phase difference being less than 15% of the central wavelength, and wherein said integral horizontal extensions and said outer extension of each of said three diverging extents are respectively of lengths differing from those on the other diverging extents by a small proportion of the length of said diverging extent to provide said phase difference.

* * * * *